US008186858B2

(12) United States Patent
Chen

(10) Patent No.: US 8,186,858 B2
(45) Date of Patent: May 29, 2012

(54) AUXILIARY ILLUMINATING STRUCTURE FOR HAND TOOL

(76) Inventor: Ming-Nan Chen, Taichung (TW)

( * ) Notice: Subject to any disclaimer, the term of this patent is extended or adjusted under 35 U.S.C. 154(b) by 197 days.

(21) Appl. No.: 12/662,297

(22) Filed: Apr. 9, 2010

(65) Prior Publication Data

US 2011/0249426 A1 Oct. 13, 2011

(51) Int. Cl.
*F21V 21/00* (2006.01)

(52) U.S. Cl. ..... 362/398

(58) Field of Classification Search ..... 362/398
See application file for complete search history.

(56) References Cited

U.S. PATENT DOCUMENTS 3,706,882 A * 12/1972 Eby ..... 362/398
7,575,347 B1 * 8/2009 Daly ..... 362/398
2009/0067165 A1 * 3/2009 Sanoner et al. ..... 362/191

* cited by examiner

*Primary Examiner* — Robert May

(57) ABSTRACT

An illuminating structure for a hand tool contains a lamp comprised of a light seat, an illuminating set, a cover member, and two magnetic members, wherein the light seat includes a receiving portion disposed on a top surface thereof to receive the illuminating set, and includes a plurality of holes mounted on two sides thereof and communicating with the receiving portion, includes a slot mounted on a bottom surface thereof to receive the magnetic members, and the slot includes two bores fixed on two sides thereof individually and communicating with the receiving portion to connect with the illuminating set; the illuminating set is used to make light; the cover member is covered to the receiving portion; the magnetic member is a magnet made of metal material to conduct electricity and fixed to the slot so as to contact with the electrode conducting piece of the illuminating set.

2 Claims, 4 Drawing Sheets

AUXILIARY ILLUMINATING STRUCTURE FOR HAND TOOL

BACKGROUND OF THE INVENTION

1. Field of the Invention

The present invention relates to an illuminating structure for a hand tool to attach hand tools with different size and turning on the bulbs by attaching the hand tool without pressing a button.

2. Description of the Prior

TW Pat. No. M309642 discloses a tool lamp is portable easily and includes a housing and a cover to cover related components of the tool lamp, and includes a retaining hole to insert a hand tool.

TW Publication No. 484492 discloses an auxiliary illuminating structure for a hand tool includes an illuminating device fitted to a hand tool to make light and including a housing, a bulb, a cell, a conducting member, and a button, wherein the housing includes a first receiving room to receive the cell, the conducting member, and the button, includes a second receiving room to receive the bulb and allowing to adjust the bulb at different angles, includes a positioning portion connected with the hand tool, the positioning portion includes a magnetic member fixed on an inner wall thereof to attach the illuminating device with the hand tools, such as a screw driver or a wrench together.

However, such conventional tool lamp and illuminating device can not attach the hand tools with different sizes, and can not turn on the bulbs by attaching the hand tool.

The present invention has arisen to mitigate and/or obviate the afore-described disadvantages.

SUMMARY OF THE INVENTION

The primary object of the present invention is to provide an illuminating structure for a hand tool that can attach hand tools with different sizes by using the magnetic members.

Another object of the present invention is to provide an illuminating structure for a hand tool that can attach hand tool by using the magnetic members to conduct power source to illuminate the bulbs automatically without pressing a button.

An illuminating structure for a hand tool according to the present invention comprises a lamp comprised of a light seat, an illuminating set, a cover member, and two magnetic members, wherein the light seat includes a receiving portion disposed on a top surface thereof to receive the illuminating set, and includes a plurality of holes mounted on two sides thereof and communicating with the receiving portion, includes a slot mounted on a bottom surface thereof to receive the magnetic members, and the slot includes two bores fixed on two sides thereof individually and communicating with the receiving portion to connect with the illuminating set;

the illuminating set is used to make light;

the cover member is covered to the receiving portion;

the magnetic member is a magnet made of metal material to conduct electricity and fixed to the slot so as to contact with the electrode conducting piece of the illuminating set.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
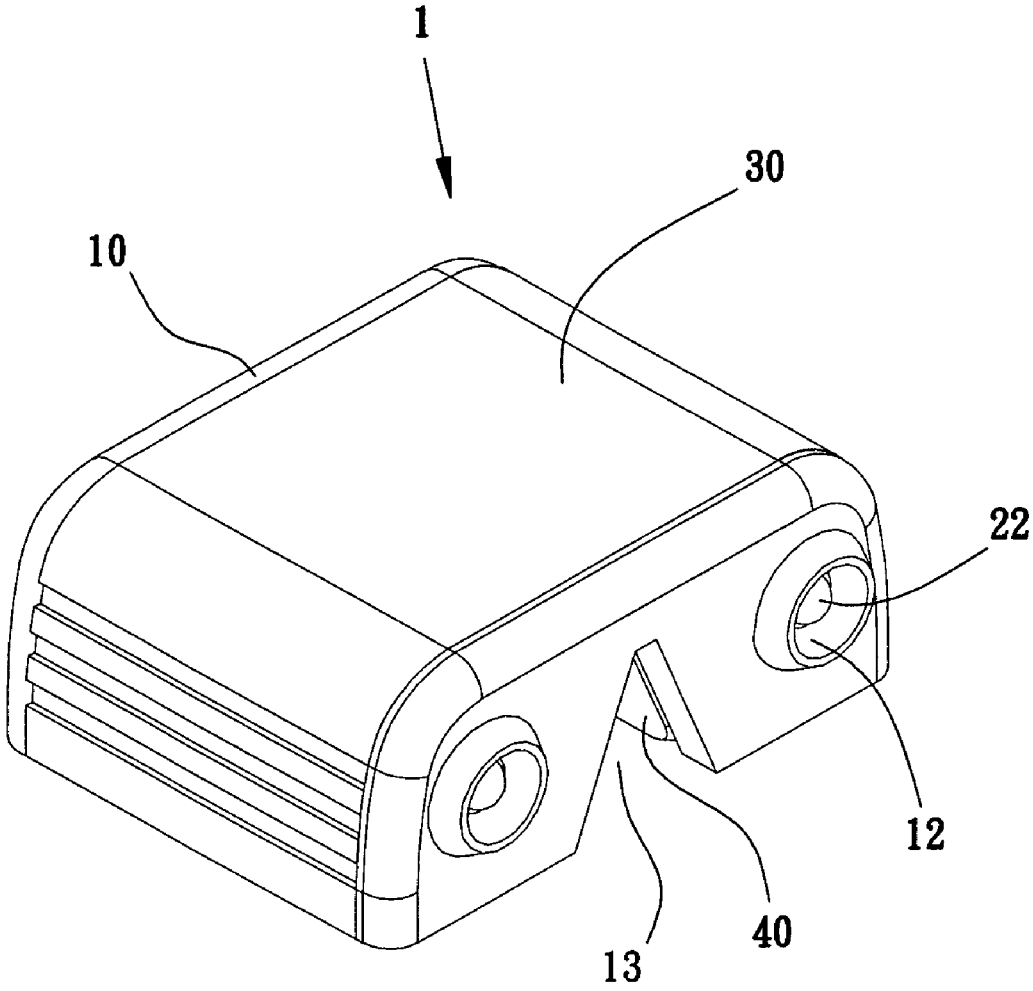
FIG. 1 is a perspective view showing the assembly of an illuminating structure for a hand tool according to a preferred embodiment of the present invention.
Figure 2:
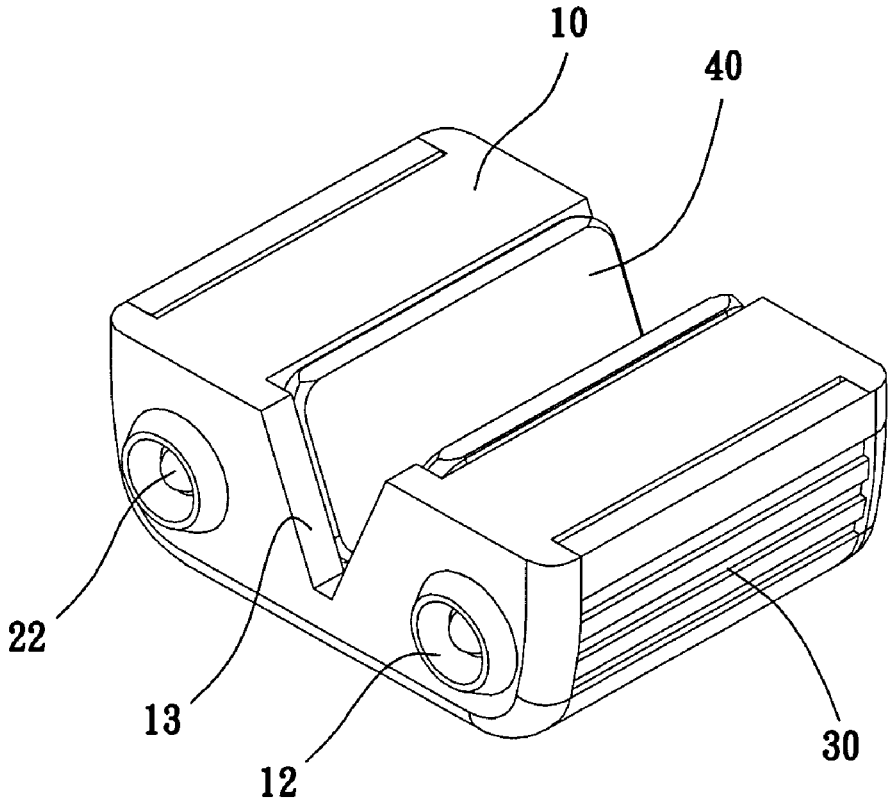
FIG. 2 is another perspective view showing the assembly of the illuminating structure for the hand tool according to the preferred embodiment of the present invention.
Figure 3:
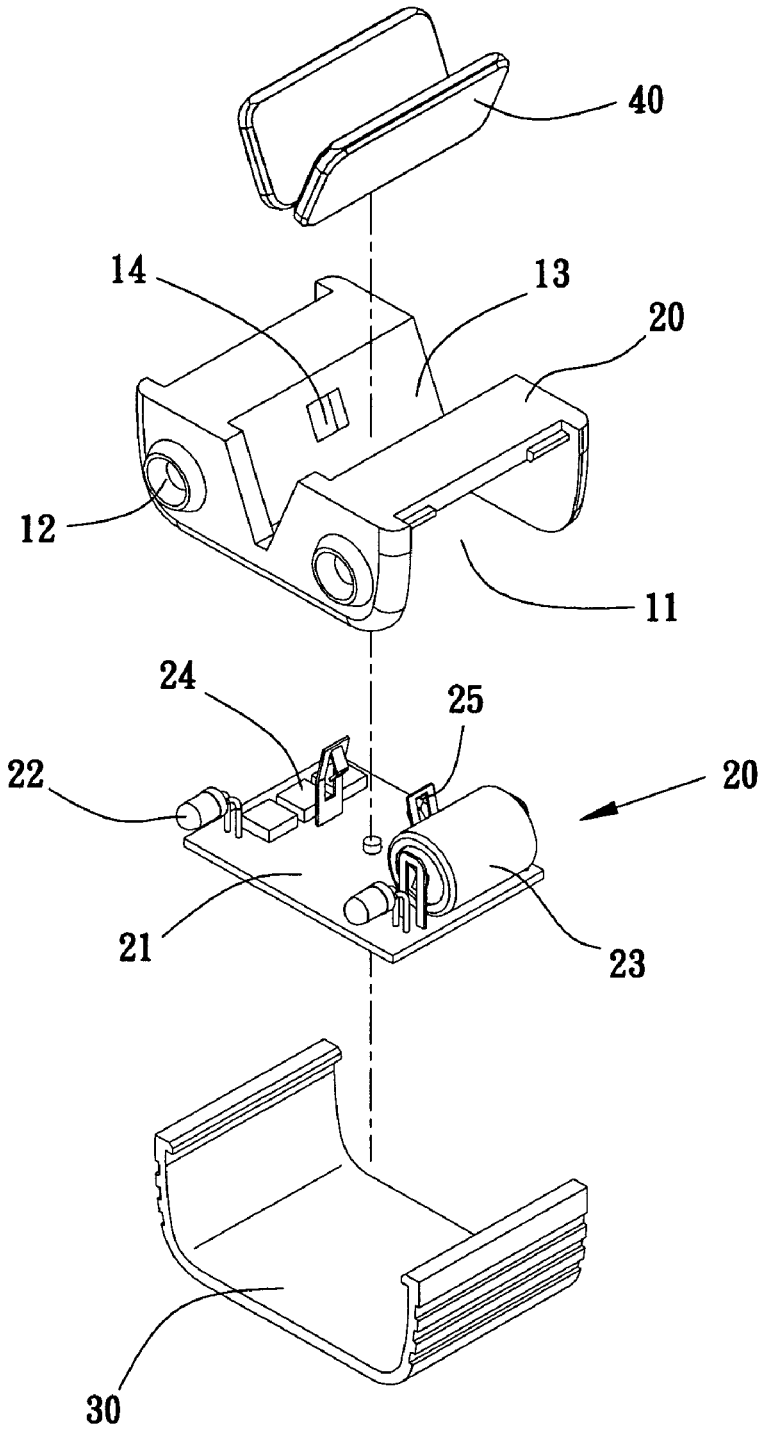
FIG. 3 is a perspective view showing the exploded components of the illuminating structure for the hand tool according to the preferred embodiment of the present invention.
Figure 4:
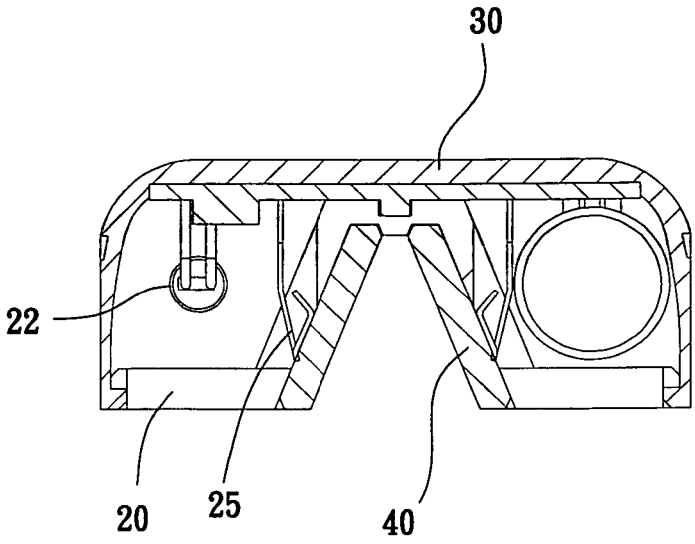
FIG. 4 is a cross sectional view showing the assembly of the illuminating structure for the hand tool according to the preferred embodiment of the present invention.
Figure 5:
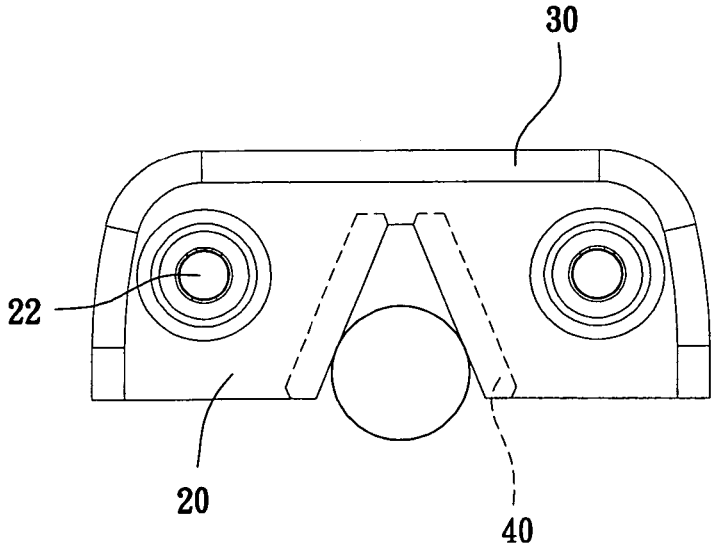
FIG. 5 is a plan view showing the operation of the illuminating structure for the hand tool according to the preferred embodiment of the present invention.

Referring to FIGS. 1-5, an auxiliary illuminating structure for a hand tool according to the present invention includes a lamp 1 comprised of a light seat 10, an illuminating set 20, a cover member 30, and two magnetic members 40.

The light seat 10 is formed in an inverted C shape and includes a receiving portion 11 disposed on a top surface thereof to receive the illuminating set 20, and includes a plurality of holes 12 mounted on two sides thereof and communicating with the receiving portion 11, includes an inversely V-shaped slot 13 mounted on a bottom surface thereof to receive the magnetic members 40, and the slot 13 includes two bores 14 fixed on two sides thereof individually and communicating with the receiving portion 11 to connect with the illuminating set 20.

The illuminating set 20 includes a circuit board 21 having two bulbs 22, a power source 23, a number of electronic elements 23, and two electrode conducting pieces 25 so that when the electrode conducting pieces 25 are conducted, the power source is transmitted to the bulbs 22 to make light. The illuminating set 20 is installed to the receiving portion 11 of the light seat 10, and the bulbs 22 are fitted to the holes 12 respectively, the electrode conducting pieces 25 are fitted to the bores 14 individually to contact with the magnetic members 40.

The cover member 20 is formed in an inverted C shape, and when the illuminating set 20 is placed to the receiving portion 11 of the light seat 10, the cover member 20 is covered to the receiving portion 11.

The magnetic member 40 is a magnet made of metal material, such as iron, cobalt, and nickel to conduct electricity and fixed to the slot 13 so as to contact with the electrode conducting piece 25 of the illuminating set 20. When the magnetic members 40 attaches a hand tool, two electrodes are conducted so that the bulbs 22 make light, and when the magnetic members 40 disengage from the hand tool, the power source is turned off.

Thereby, the lamp 1 can attach hand tools with different sizes by using the magnetic members 40 to conduct power source to illuminate the bulbs simultaneously, and when the hand tool is removed, the power source is turned off automatically, thus obtaining operating convenience.

While we have shown and described various embodiments in accordance with the present invention, it is clear to those skilled in the art that further embodiments may be made without departing from the scope of the present invention.

What is claimed is:

1. An illuminating structure for a hand tool comprising:

a lamp comprised of a light seat, an illuminating set, a cover member, and two magnetic members, wherein the light seat includes a receiving portion disposed on a top surface thereof to receive the illuminating set, and includes a plurality of holes mounted on two sides thereof and communicating with the receiving portion, includes a slot mounted on a bottom surface thereof to receive the two magnetic members, and the slot includes two bores fixed on two sides thereof individually and communicating with the receiving portion to connect with the illuminating set;

the illuminating set is used to make light;

the cover member covers the receiving portion;

the two magnetic members are a magnet made of metal material to conduct electricity and are disposed inside of the slot contacting with two electrode conducting pieces of the illuminating set;

the illuminating set includes a circuit board having two bulbs, a power source, a number of electronic elements, and the two electrode conducting pieces;

the two bores communicate with the two electrode conducting pieces when electricity passes through the electrode conducting pieces, the power source is activated.

2. The illuminating structure for the hand tool as claimed in claim 1, wherein the slot is formed in an inverted V shape.

* * * * *